United States Patent [19]

Kawakami et al.

[11] 3,989,364

[45] Nov. 2, 1976

[54] ELECTROPHOTOGRAPHIC COPYING APPARATUS

[75] Inventors: Touhei Kawakami; Kunio Tajima; Seiichi Hayashi, all of Hitachi, Japan

[73] Assignee: Hitachi, Ltd., Japan

[22] Filed: Feb. 18, 1975

[21] Appl. No.: 550,345

[30] Foreign Application Priority Data

Feb. 22, 1974 Japan ..... 49-20545

[52] U.S. Cl. ..... 355/3 R; 96/1 R; 340/173 LS; 355/4; 355/14

[51] Int. Cl.[2] ..... G03G 15/00

[58] Field of Search ..... 355/3 R, 14, 15, 17, 355/133, 4; 96/1 R, 1.4; 340/173 LM, 173 LS

[56] References Cited

UNITED STATES PATENTS

| | | | |
|---|---|---|---|
| 3,055,006 | 9/1962 | Dreyfoos | 340/173 TP |
| 3,148,354 | 9/1964 | Scheffert | 340/173 LS |
| 3,659,936 | 5/1972 | Klose et al. | 355/3 R |
| 3,671,231 | 6/1972 | Haas et al. | 96/1 R |
| 3,678,852 | 7/1972 | Feinleib et al. | 340/173 LM |
| 3,772,011 | 11/1973 | Guevara et al. | 96/1 R |
| 3,857,635 | 12/1974 | Niehaus | 355/85 X |
| 3,868,653 | 2/1975 | Winter | 340/173 LS |
| 3,879,197 | 4/1975 | Bartlett et al. | 96/1 R |
| 3,888,664 | 6/1975 | Carlson et al. | 96/1 R |
| 3,891,990 | 6/1975 | Wells | 96/1 R |

*Primary Examiner*—R. L. Moses

*Attorney, Agent, or Firm*—Craig & Antonelli

[57] ABSTRACT

A sintered body obtained by sintering a mixture of lead monoxide, titanium dioxide, zirconium dioxide and lanthanum oxide under a certain condition, is used as transfer master. The transfer master is subjected to electric polarization in accordance with the original picture to be copied so that a plurality of electrophotographic copies are swiftly produced.

2 Claims, 14 Drawing Figures

ELECTROPHOTOGRAPHIC COPYING APPARATUS

BACKGROUND OF THE INVENTION

1. Field of the Invention

The present invention relates to an electrophotographic copying apparatus and more particularly to an electrophotographic copying apparatus in which the transfer of images is performed by a transfer master having interval polarization.

2. Description of the Prior Art

In an electrophotographic copying apparatus for copying original pictures according to the electrophotographic principle a series of steps of procedure, i.e. electrification of transfer master-exposure-development and transfer to recording medium-fixation and cleaning of transfer master, are performed each time a copy is produced. These series of steps are completely repeated even if the same original is used to produce a plurality of copies thereof. In order to shorten the time required for copying, it is only necessary to decrease the time required for each of the aforementioned steps. However, the step of electrification cannot be of too short a time since the time for effecting uniform electrification depends on the dimensions of the area to be electrified. In addition, it is also difficult to shorten the time for the step of exposure since exposure time, i.e. necessary quantity of light for exposure, should be determined by the sensitivity of material.

SUMMARY OF THE INVENTION

One object of the present invention is to provide an electrophotographic copying apparatus using a transfer master which can be electrically polarized.

Another object of the present invention is to provide an electrophotographic copying apparatus adapted especially for producing a multiplicity of copies of an original.

Still another object of the present invention is to provide an electrophotographic copying apparatus whose copying speed is very fast.

According to one of the features of the present invention, a transfer master having a specific characteristic of electric polarization is polarized in accordance with the original picture, the transfer master is developed and the image of the original is transferred onto recording medium.

DESCRIPTION OF THE PREFERRED EMBODIMENTS

Figure 1:
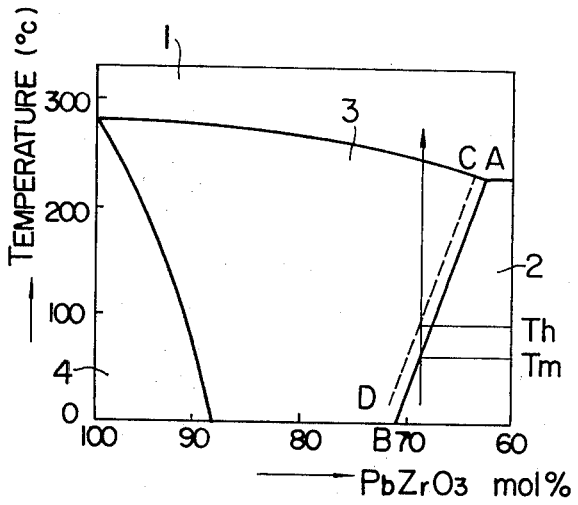
FIG. 1 is a phase diagram for ceramic material used as transfer master.
Figure 2:
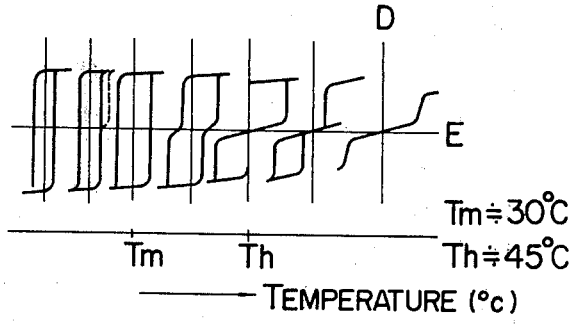
FIG. 2 shows the temperature dependence of the hysteresis curves near the ferroelectric-antiferroelectric transition temperature of the ceramic material.
Figure 3:
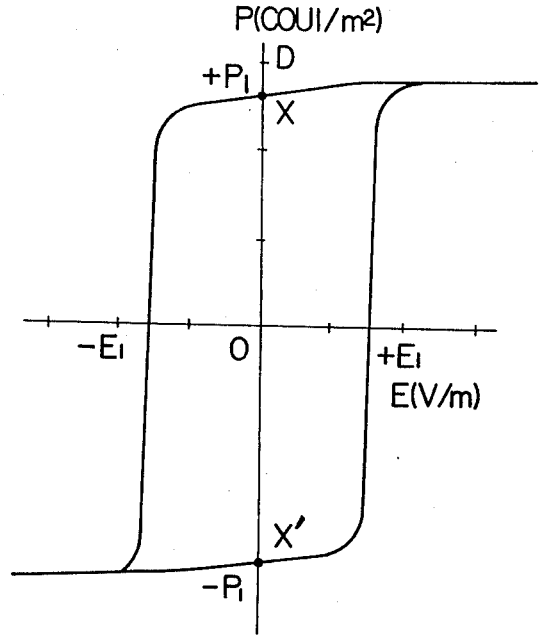
FIGS. 3 and 4 show hysteresis curves.
Figure 4:
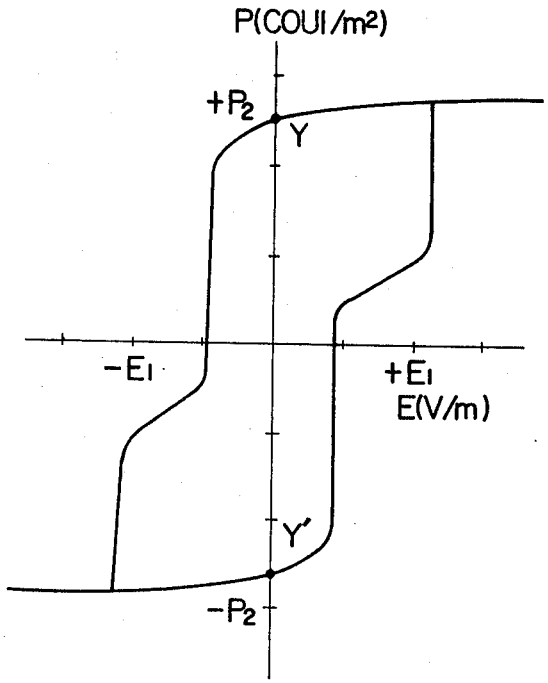

First of all, description will be made of material for transfer master. In the embodiment of the present invention, a sintered body of lead monoxide PbO, titanium dioxide $TiO_2$, zirconium dioxide $ZrO_2$ and lanthanum oxide $La_2O_3$ (hereinafter referred to for brevity as PLZT ceramic material) is a typical example of the transfer master. The PLZT ceramic material is prepared according to the following process. First, the mixed powder of PbO $TiO_2$, $ZrO_2$ and $La_2O_3$ is subjected to solid-phase reaction through the primary pre-sintering, to form PLZT powder. The PLZT powder is further ground for making the grains uniform, dried up, well mixed and subjected to the secondary pre-sintering. The thus treated product has water added and is then sifted. The sifted powder is shaped through press-shaping to have a solid form. The solid formed material is subjected to hot press treatment for 20 hours at 1200° C and 140 Kg/cm$^2$ (about 200 psi) so that PLZT ceramics having a grain size of 5 to 6 $\mu$ is produced. Another method for producing such a ceramic is to use wet reaction in acetic solution of Pb and La. This method does not specifically affect the quality of the final product. The PLZT ceramics prepared according to the process described above gives the phase diagram shown in FIG. 1. In FIG. 1, reference numerals 1, 2, 3 and 4 indicate a paraelectric phase, a ferroelectric phase, an antiferroelectric phase $\beta$ and an antiferroelectric phase $\alpha$, respectively. The domain near $PbTiO_3$ belongs to a ferroelectric phase of tetragonal system having Curie point of 400° to 500° C while the domain near $PbZrO_3$ corresponds to a ferroelectric phase of trigonal system. $PbZrO_3$ itself is an antiferroelectric substance, but if it contains a bit of $O_3$ in the form of solid solution, it belongs to the antiferroelectric phase $\alpha$ 4 at room temperatures, is changed to the antiferroelectric phase $\beta$ 3 at 200° to 300° C, and is turned to a paraelectric substance of tetragonal system at still higher temperatures. If a small amount of La is added to $PbZrO_3$, the antiferroelectric phase $\beta$ 3 shifts toward $Pb(ZrTi)O_3$ and a very sharp peak of dielectric constant appears at the transition temperature from phase 3 to phase 1. As described above, the PLZT ceramics belongs to the trigonal system and when it is placed in an electric field, it easily exhibits orientation polarization with the result that the D-E hysteresis (on the boundary between ferroelectric and ferroelectric phases or between ferroelectric and antiferroelectric phases) has a saturation characteristic as shown in FIG. 3. If the sample (PLZT ceramics) is heated, the coersive force E decreases gradually with temperatures, as shown in FIG. 2. When the temperature approaches the ferroelectric-antiferroelectric phase transition temperature, the coersive force E increases by degrees until a double hysteresis loop as shown in FIG. 4 has been formed. The double hysteresis loop appears from a temperature of Tm upward while the polarization begins to vanish from a temperature of Th upward. Usually, $\Delta T(=Th-Tm)$ is a very small temperature range of less than 1° C, but the ferroelectric-antiferroelectric phase transition temperature of the PLZT ceramics ranges more than 10° C. The double hysteresis loop suggests that the phases can be forcibly changed from one to another by the application of electric field. Namely, the PLZT ceramics is changed to the antiferroelectric phase $\beta$ 3 when it is heated up to temperatures beyond the dotted line CD in FIG. 1. The solid line AB corresponds to the temperature Tm at which double hysteresis appears. Accordingly, within the domain between the lines AB and CD, the antiferroelectric phase $\beta$ 3 is stable and the ferroelectric phase 2 is quasi-stable under over-heated condition. In a region just beneath the line AB, the ferroelectric phase 2 is stable and the antiferroelectric phase $\beta$ 3 is quasi-stable under over-cooled condition. Therefore, there is an intermediate state between the ferroelectric phase 2 and the antiferroelectric phase 3. By forcibly performing the phase-to-phase transition in the intermediate state through the application of electric field, the reversible transition between the ferroelectric phase having memory function and the antiferroelectric phase not having memory function, becomes possible.

Figure 5:
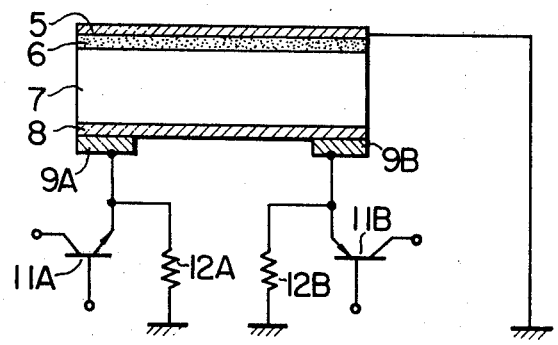
FIG. 5 is an electric wiring diagram of an electrophotographic copying apparatus according to the present invention.
Figure 6:
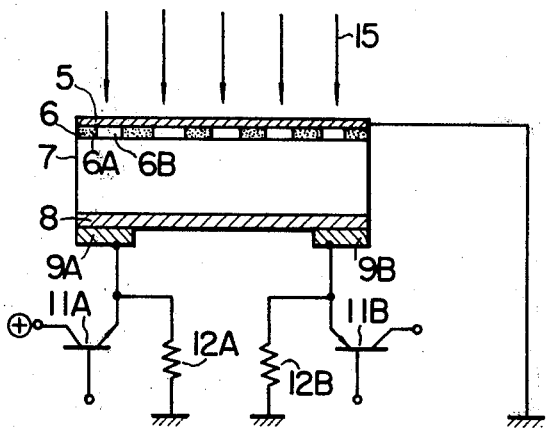
FIG. 6 shows the step of exposure in the apparatus in FIG. 5.

The present invention utilizes such a PLZT ceramic material and the fundamental structure thereof will be described below. In FIGS. 5 and 6, a transparent conductive layer 5 is made of Nesa or hot-pressed solid solution of $In_2O_3$—$O_2$ and has an excellent transparency and uniformity. A thin film of CuI, which is formed by iodizing a thin film of vapor-deposited Cu in the vapor of I, can be used also as the transparent conductive layer. Au organic photoconductive material (hereinafter referred to for brevity as OPC) 6 is a polyvinylcarbazole film having trinitrofluorenon as sensitizer or a vinylcarbazole bromide polymer film using triallylcarbonium salt or benzopyrylium salt as sensitizer. A film-making high polymer and plasticizer, having good compatibility may be added to the film material to a suitable extent. Reference numerals 7 and 8 indicates such a PLZT ceramics as described above and a detachable conductive layer, respectively. The material for the conductive film 8 is not specified. Electrodes 9A and 9B are connected with the emitters of an NPN transistor 11A and an PNP transistor 11B and also grounded through resistors 12A and 12B.

Figure 7:
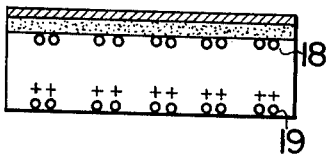
FIG. 7 schematically shows the state of polarization in the ceramic material used as transfer master.
Figure 8:
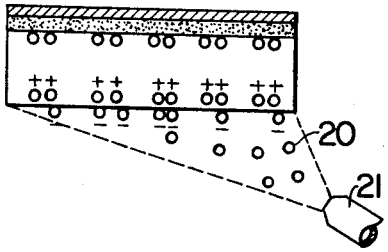
FIG. 8 shows the step of development.
Figure 9:
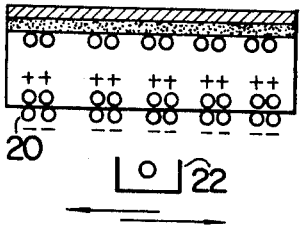
FIG. 9 shows the step of controlling the diaphragm.
Figure 10:
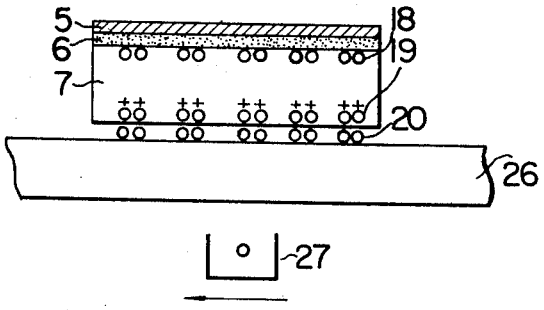
FIG. 10 shows the step of transfer.
Figure 11:
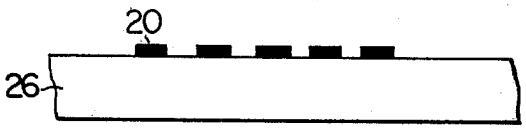
FIG. 11 is a side view of recording medium.

With this structure, if the light rays 15 from the original picture is projected on the transparent conductive film 5, as shown in FIG. 6, then the light passes through the film 5 and reaches the OPC 6. When the OPC 6 receives the light, the resistivity thereof decreases to a great extent (several hundred to several thousand times) so that the OPC 6 is divided into high resistance regions 6A and low resistance regions 6B. If current is caused to flow for a very short time between the conductive films 5 and 8 through the transistor 11A, the electric field between the low resistance region 6B and the conductive film 8 largely differs from that between the high resistance region 6A and the conductive film 8. Accordingly, the light rays 15 from the original creates the distribution of electric field corresponding to the original picture in the PLZT ceramic plate 7 and at this time the transition of phase takes place in the PLZT ceramics, that is, the ceramics assumes the property of forroelectric substance to become dispersive. Next, the change of the inside of the PLZT ceramics 7 will be considered with the aid of the hysteresis curve shown in FIG. 3. Since the emitter of the transistor 11A is maintained at $+E_1$ volt, the curve is followed upward to the right with the increase in the voltage and when the voltage vanishes, the curve should be followed downward to the left until the stable point x is reached where the change in state is stopped. Consequently, the PLZT ceramic plate 7 holds charges of $+P_1$ coul/m$^2$ in the inside thereof and charges of $-P_1$ coul/m$^2$ in the boundary between itself and the OPC 6. In this case, the removal of the conductive film 8 causes no influence on the distribution of polarization attained as above. Let the internal and boundary charges described above by referred to as internal polarizations B and A, respectively. Then, latent images 18 and 19 having such charge distributions as shown in FIG. 7 are formed. If toner 20 is sprayed from a nozzle 21, as shown in FIG. 8, to adhere to the ceramic plate 7 due to the Coulomb force by the latent image 19, a developed toner image corresponding to the original picture is formed as shown in FIG. 9. The toner image contains solvent as well as toner compound and therefore the solvent must be removed to improve the resolving power. For this purpose, the focussing operation is performed in which the charges having the opposite polarity to those of the tonar particles are given by an electrifier 22, as shown in FIG. 9. A recording medium 26 is disposed nearer than a few microns to the surface of the developed image, as shown in FIG. 10 and the charges having the opposite polarity to those of the toner 20 are given to the recording medium by means of an electrifier 27 to transfer the developed toner image onto the recording medium 26. The toner image transferred to the recording medium 26 is fixed according to a treatment suitable for the composition of the toner used (for example, heating and fusing treatment) so that a copy is completed as shown in FIG. 11.

Figure 12:
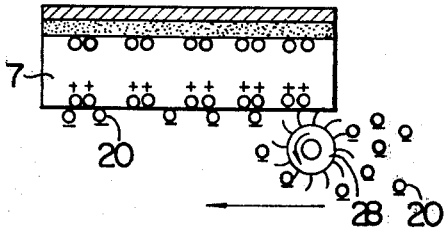
FIG. 12 shows the step of cleaning.

After the completion of copying, the PLZT ceramic plate 7 is swept by, for example, a fur brush 28 to remove the residual toner, as shown in FIG. 12. Since the internal polarization, i.e. latent image, 19 still exists, the developing step shown in FIG. 8 is started for another copy.

When it is required to change the recording information, i.e. original picture to be copied, the PLZT ceramic plate 7 is heated to forcibly cause the phase transition. As a result, the internal polarizations are completed eliminated so that the ceramic plate 7 is prepared for a new copying process.

Figure 13:
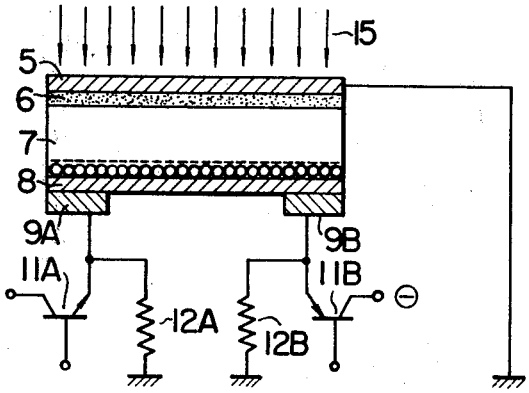
FIG. 13 shows the step of neutralizing the polarization.

As the way of electronically eliminating the internal polarizations (latent images) is known an artifice in which the ceramic plate 7 placed in an electric field is exposed to the uniform rays of light. Namely, as shown in FIG. 13, the OPC 6 is grounded, the conductive layer 8 is kept in contact with the PLZT ceramic plate 7, and the electrode 9B is connected with a power source through transistor 11B. In this way, the conductive film 8 is kept at the potential opposite to that required in case of copying operation and the OPC 6 is exposed to the uniform rays of light to make the entire surface thereof conductive. Thus, the PLZT ceramic plate 7 is uniformly polarized with the polarities opposite to those of the latent images so that the latent images are nuetralized and substantially eliminated. With this method of eliminating the latent images, the polarity of the surface charges in the ceramic plate 7 is the same as that of the charges on the toner particles so that the elimination of the residual toner is self-improved. In addition, the polarity of the uniform polarization is opposite to that of the latent image and therefore there is obtained an advantage that the contrast (potential difference) between the non-polarized portion and the polarized portion corresponding to the latent image formed in the next exposure step is large.

As described above, if the PLZT ceramic plate is used as transfer master, the electrification and exposure steps are not needed in the operation of producing the second copy and the successive ones so that about 20 percent of copying time can be saved. Namely, the conventional electrophotographic copying apparatus must be performed a series of steps of procedure: electrification (15 percent) — exposure (8 percent) — development (43 percent) — transfer (15 percent) — cleaning (8 percent), for every copy, but according to the apparatus embodying the present invention the steps of electrification (15 percent) and exposure (8 percent) can be omitted. The percentages in the parentheses refer to the proportions of the time required for a single cycle of copying operation, covered by the respective steps.

When this technique described above is applied to a color copying apparatus, only a transfer master can be used for plural primary colors.

Since the PLZT ceramics are very hard, the abrasion in the steps of transfer and cleaning is very small, the transfer master having a long useful life.

Figure 14:
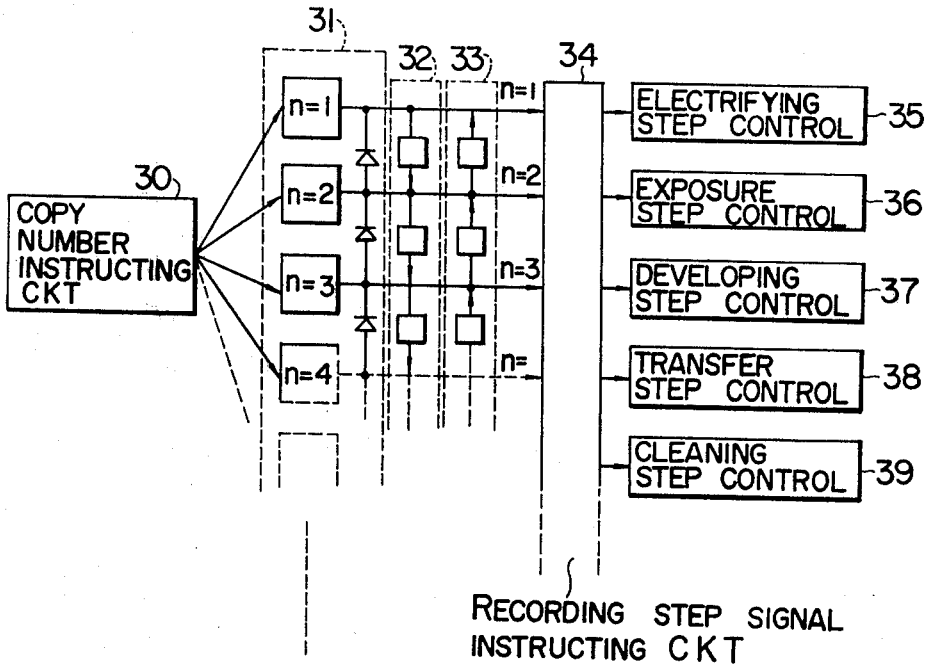
FIG. 14 is the block diagram of the control system for use in the apparatus.

Next, description will be made of how the omission of certain steps is controlled in the copying operation in which a plurality of copies are produced from an original picture. Reference should be made now to FIG. 14, in which reference numeral 30 designates a copy number instructing circuit which determines the number of copies produced from the same original; 31 a copy number signal generating circuit; 32 an electrification - exposure step omission signal generating circuit; 33 a cleaning step omission signal generating circuit; 34 a recording step instructing circuit; 35 an electrifying step (preparation of latent images through polarization) control means; 36 an exposure step control means; 37 a developing step control means; 38 a transfer step control means and 39 a cleaning step control means. The copy number instructing circuit 30 sends an instruction of the number of like copies to be produced from an original to the copy number signal generating circuit according to the manipulation of an operator. Then, the copy number signal generating circuit 31 delivers a signal representing the required number $n$ of copies to be produced. For example, if a signal corresponding to $n = 3$ is generated by the circuit 31, the recording step instructing circuit 34 is so instructed as to repeat the step of recording $n$ times and drives the control means 35 to 39. In this case ($n = 3$), all the instruction input terminals for $n = 1$, 2 and 3, of the instructing circuit receive their respective inputs. In addition, the terminals for $n = 2$ and 3 receive an instruction to omit the steps of electrification and exposure from the electrification - exposure step omission signal generating circuit 32. Further, the terminals for $n = 1$ and 2 receive an instruction to omit the step of cleaning from the cleaning step omission signal generating circuit 33. First, the recording step instructing circuit 34 successively instructs the means 35 to 39 to perform the recording step (electrification - exposure - development - transfer) according to the signal for $n = 1$ (including a cleaning step omission signal). Thus, the step of the first recording is completed. Then, the recording step (development - transfer) is instructed according to the signal for $n = 2$ (including a signal for omitting the steps of electrification, exposure and cleaning). For $n = 3$, the third copy is completed by the electrification - exposure step omission signal. Thereafter, the internal polarizations of the transfer master are eliminated by some suitable means so as to prepare the transfer master for another copying original.

According to the control described above, much time is saved in case of producing a multiplicity of copies from an original. The cleaning step omission signal generating circuit 33 must be removed if much residual toner is left after the transfer operation so that the quality of the reproduced pictures of the successive copies is degraded. In that case, the saving of copying time is somewhat sacrificed.

However, if such a control system as described above is incorporated in the electrophotographic copying apparatus, the steps to be omitted can be automatically controlled by the signal to indicate the number of copies to be produced so that the manipulation of the apparatus is much facilitated.

As described above, according to the present invention, an electrophotographic copying apparatus can be provided which has a long useful life and can operate very fast in some cases.

We claim:

1. An electrophotographic copying apparatus comprising a transfer master which is polarized in accordance with an electric field applied thereto, the polarization being kept after the field is removed; means for applying to said transfer master an electric field corresponding to the original picture to be copied; means for developing said transfer master; and means for transferring the developed image on said transfer master to a recording medium; said transfer master being a sintered body of lead monoxide, titanium dioxide, zirconium dioxide and lanthanum oxide, and further including a transparent electrode having a photoconductive layer, kept in contact with one of the principal surfaces of said transfer master; and means for exposing said photoconductive layer through said transparent electrode in accordance with the original picture and for applying the potential at said transparent electrode to said transfer master through said photoconductive layer.

2. An electrophotographic copying apparatus comprising a transfer master which is polarized in accordance with an electric field applied thereto, the polarization being kept after the field is removed; means for applying to said transfer master an electric field corresponding to the orignal picture to be copied; means for developing said transfer master; means for transferring the developed image on said transfer master to a recording medium; and further comprising a copy number instructing circuit; step instructing circuits for instructing the repetition of the recording process, the number of the repetition being determined by the output of said copy number instructing circuit; and a step omission circuit for instructing said step instructing circuit to omit the steps of electrification and exposure for the second copying operation and the successive ones in case of producing a plurality of copies from an original picture.

* * * * *